US005290650A

United States Patent [19]

Shintaku et al.

[11] Patent Number: 5,290,650

[45] Date of Patent: Mar. 1, 1994

[54] ELECTROSTATIC IMAGE-DEVELOPING POSITIVELY CHARGEABLE TONER AND DEVELOPER

[75] Inventors: Takashi Shintaku, Machida; Mikio Uno, Odawara; Yoshihiro Kigami, Fujisawa, all of Japan

[73] Assignee: Mitsubishi Kasei Corporation, Tokyo, Japan

[21] Appl. No.: 882,538

[22] Filed: May 13, 1992

[30] Foreign Application Priority Data

May 13, 1991 [JP] Japan ..... 3-107562

[51] Int. Cl.[5] ..... G03G 9/08

[52] U.S. Cl. ..... 430/106; 430/110

[58] Field of Search ..... 430/106, 108, 110

[56] References Cited

U.S. PATENT DOCUMENTS 4,980,258 12/1990 Aoki et al. ..... 430/108
5,021,317 6/1991 Matsubara et al. ..... 430/110

FOREIGN PATENT DOCUMENTS 0288693 11/1988 European Pat. Off. .
0369443 5/1990 European Pat. Off. .
0378181 7/1990 European Pat. Off. .
2818825 11/1978 Fed. Rep. of Germany .
3836388 5/1989 Fed. Rep. of Germany .

*Primary Examiner*—John Goodrow
*Attorney, Agent, or Firm*—Oblon, Spivak, McClelland, Maier & Neustadt

[57] ABSTRACT

An electrostatic image-developing positively chargeable toner comprising at least toner particles containing a resin and a colorant, and conductive fine particles having their surface treated with a positively chargeable resin.

17 Claims, No Drawings

ELECTROSTATIC IMAGE-DEVELOPING POSITIVELY CHARGEABLE TONER AND DEVELOPER

The present invention relates to an electrostatic image-developing positively chargeable toner and developer to be used for an electrophotographic method or an electrostatic recording method.

A developer for e.g. an electrophotographic copying machine is, in a developing step, once deposited on an image-carrier such as a photoreceptor on which an electrostatic image is formed, then in a transfer step, transferred from the photoreceptor to a transfer paper and then in a fixing step, fixed on a copying paper. Here, as the developer for developing the electrostatic image formed on the latent image-maintaining surface, a two-component developer comprising a carrier and a toner and a one-component developer (magnetic toner) requiring no carrier, are known.

Heretofore, a positively chargeable toner has been known as a toner suitable for electrophotography employing an organic photoreceptor. As an agent for imparting a positive charge to the toner, a charge-controlling agent such as a Nigrosine dye, a triaminotriphenyl methane compound or a quaternary ammonium salt, or a coating agent for a magnetic carrier, has, for example, been known.

However, the charge-imparting effects of these conventional positive charge-imparting agents are not necessarily adequate, and it is difficult to obtain a formulation whereby a proper chargeability is obtained constantly irrespective of e.g. the environment, and the change with time of the charge is preferable. Particularly when the developer is exposed at a high temperature for a long period of time, for example, during the handling or storage in summer time, an image-staining such as fogging is likely to result when continuous copying is conducted using such a developer, and it is difficult to obtain a constant copy density, and there has been a problem such that building up of charge is poor, whereby the toner tends to scatter in the copying machine.

Heretofore, it has been proposed to incorporate a magnetic powder such as magnetite or chromium dioxide to the developer to impart electrical conductivity, so that the charge of the carrier or the charge of the toner is permitted to leak, or to impart a cleaning property on the photoreceptor (Japanese Unexamined Patent Publications No. 105236/1983, No. 118652/1983 and No. 237560/1989). The above-mentioned problem tends to be remarkable especially when such conductive fine particles are incorporated.

The present inventors have conducted extensive studies to solve such a problem and, as a result, have found it possible to obtain a positively chargeable toner excellent in the chargeability with less deterioration due to the environment or less change with time of the image quality, by incorporating conductive fine particles having a certain specific treatment applied thereto. The present invention has been accomplished on the basis of this discovery.

Thus, the present invention provides an electrostatic image-developing positively chargeable toner comprising at least toner particles containing a resin and a colorant, and conductive fine particles having their surface treated with a positively chargeable resin.

Now, the present invention will be described in detail with reference to the preferred embodiments.

The binder resin for the toner of the present invention may be selected from a wide range of resins including known resins. For example, it may be a styrene resin (a homopolymer or copolymer of styrene or a substituted styrene) such as polystyrene, chloropolystyrene, poly-α-methylstyrene, a styrene-chlorostyrene copolymer, a styrene-propylene copolymer, a styrene-butadiene copolymer, a styrene-vinyl chloride copolymer, a styrene-vinyl acetate copolymer, a styrene-maleic acid copolymer, a styrene-acrylate copolymer (such as a styrene-methyl acrylate copolymer, a styrene-ethyl acrylate copolymer, a styrene-butyl acrylate copolymer, a styrene-octyl acrylate copolymer or a styrene-phenyl acrylate copolymer), a styrene-methacrylate copolymer (such as a styrene-methyl methacrylate copolymer, a styrene-ethyl methacrylate copolymer, a styrene-butyl methacrylate copolymer or a styrene-phenyl methacrylate copolymer), a styrene-α-methyl chloroacrylate copolymer, or a styrene-acrylonitrile-acrylate copolymer, a vinyl chloride resin, a rosin-modified maleic acid resin, a phenol resin, an epoxy resin, a saturated or unsaturated polyester resin, a low molecular weight polyethylene, a low molecular weight polypropylene, an ionomer resin, a polyurethane resin, a silicone resin, a ketone resin, an ethylene-ethyl acrylate copolymer, a xylene resin, or a polyvinylbutyral resin. Particularly preferred for the present invention may, for example, be a styrene resin, a saturated or unsaturated polyester resin and an epoxy resin. These resins may be used alone or in combination as a mixture of two or more.

With respect to the glass transition temperature of the binder resin for the toner, the transition initiation temperature (turning point) is required to be at least 57° C. as measured by a differential thermal analyzer or a differential scanning calorimeter. If the glass transition initiation temperature is lower than 57° C., when left to stand at a high temperature of at least 40° C. for a long period of time, the toner is likely to coagulate or solidify, whereby there will be a practical problem in use.

As the colorant for the toner, any conventional dyes and pigments, such as carbon black, lamp black, iron black, ultramarine blue, Nigrosine dyes, aniline blue, phthalocyanine blue, phthalocyanine green, hanza yellow G, Rodamine dyes and pigments, chrome yellow, quinacrydone, benzydine yellow, rose bengal, triarylmethane dyes, monoazo dyes and bisazo dyes and pigments, may be used alone or in combination as a mixture.

To the toner of the present invention, it is preferred to incorporate a charge-controlling agent depending upon the desired chargeability.

As such a charge-controlling agent, an optional conventional agent such as a quaternary ammonium salt, a triphenylmethane compound, a Nigrosine dye or an imidazole derivative or a metal complex thereof, may be employed.

The present invention is particularly effective for a toner containing a quaternary ammonium salt with a relatively low chargeability. As the quaternary ammonium salt, for example, a compound of the following formula (I) or (II) is preferred and specific compounds will also be listed below.

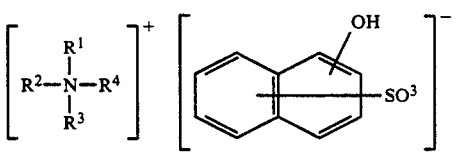

(I)

wherein each of $R^1$, $R^2$, $R^3$ and $R^4$ is a substituted or unsubstituted alkyl group or a substituted or unsubstituted aralkyl group. Particularly preferably, $R^1$ is an alkyl group having from 1 to 8 carbon atoms and each of $R^2$ and $R^3$ is an alkyl group having from 1 to 26 carbon atoms, and $R^4$ is an alkyl group or an aralkyl group having from 1 to 12 carbon atoms.

(1) $R^1$:—$C_2H_5$, $R^2$:—$C_2H_5$, $R^3$:—$C_2H_5$, $R^4$:—$CH_2$—Ph
(2) $R_1$:—$C_3H_7$, $R^2$:—$C_3H_7$, $R^3$:—$C_3H_7$, $R^4$:—$CH_2$—Ph
(3) $R_1$:—$CH_3$, $R^2$:—$C_{12}H_{25}$, $R^3$:—$CH_3$, $R^4$:—$CH_2$—Ph
(4) $R_1$:—$CH_3$, $R^2$:—$C_6H_{13}$, $R^3$:—$CH_3$, $R^4$:—$CH_2$—Ph
(5) $R_1$:—$C_4H_9$, $R^2$:—$C_4H_9$, $R^3$:—$C_4H_9$, $R^4$:—$CH_4H_9$
(6) $R_1$:—$C_2H_5$, $R^2$:—$C_{18}H_{37}$, $R^3$:—$C_2H_5$, $R^4$:—$CH_2H_5$
(7) $R_1$:—$C_8H_{17}$, $R^2$:—$C_8H_{17}$, $R^3$:—$C_8H_{17}$, $R^4$:—$CH_8H_{17}$
(8) $R_1$:—$C_8H_{17}$, $R^2$:—$C_{18}H_{37}$, $R^3$:—$C_8H_{17}$, $R^4$:—$CH_2$—$H_5$
(9) $R_1$:—$C_3H_7$, $R^2$:—$C_3H_7$, $R^3$:—$C_3H_7$, $R^4$:—$CH_2$—Ph
(10) $R_1$:—$C_4H_9$, $R^2$:—$C_4H_9$, $R^3$:—$C_4H_9$, $R^4$:—$CH_2$—Ph

Here, Ph represents a benzene ring.

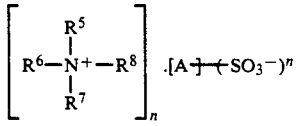

(II)

wherein each of $R^5$, $R^6$, $R^7$ and $R^8$ is a substituted or unsubstituted alkyl group or a substituted or unsubstituted aralkyl group, A is a benzene ring which may have a substituent, or a naphthalene ring which may have a substituent, and n is an integer. Preferably, each of $R^5$ and $R^7$ is a methyl group, and the total number of carbon atoms of $R^6$ and $R^8$ is at least 13, preferably at least 19, more preferably at least 30. The substituent for A may, for example, a hydroxyl group, an amino group or an alkyl group, preferably a hydroxyl group. The number of such substituents may be one or more. n is an integer of at least 2, preferably 2 or 3.

The content of the charge-controlling agent in the toner is preferably from 1 to 5 parts by weight per 100 parts by weight of the resin. If the content of the charge-controlling agent is too small, no adequate effects for improving the chargeability can be expected. On the other hand, if it is excessive, the quality of the toner tends to deteriorate.

Further, to the toner, various other additives such as a plasticizer and a releasing agent, may be incorporated for the purpose of adjusting the thermal and physical properties. The amount of such additives is usually from 0.1 to 10 parts by weight.

Furthermore, the flowability and the coagulation resistance of the toner can be improved by incorporating fine powder of e.g. $TiO_2$, $Al_2O_3$ or $SiO_2$ to the toner particles and coating the surface of the toner particles therewith. The amount of such fine powder is preferably from 1 to 10 parts by weight per 100 parts by weight of the toner particles.

For the preparation of the toner particles, various conventional methods for the production of various toners, may be employed. The following method may be mentioned as a usual method.

Firstly, the resin and the colorant (in some cases, additives including a charge-controlling agent, may be added) are uniformly dispersed by a ball mill, a V-type mixer, a S-type mixer, a Henshell mixer, etc. Then, the dispersed product is melt-kneaded by a double-arm kneader, a pressure kneader, an extruder, a roll mill, etc. The kneaded product is pulverized by a pulverizer such as a hammer mill, a cutter mill, a jet mill or a ball mill. The obtained powder is further classified by e.g. a wind-force classifier.

As the magnetic carrier to be used in combination with the toner of the present invention for a two-component developer, a conventional carrier, such as iron powder, ferrite powder, magnetite powder or magnetic resin carrier, having a particle size of from 30 to 200 μm, may be employed. Further, the one having a silicone resin, an acryl resin or a fluorine resin, or a mixture of such resins coated on the surface of such a conventional carrier, may also be preferably employed. Particularly preferred is a developer wherein a carrier of a ferrite powder coated with a silicone resin is combined with the toner of the present invention, whereby a remarkable effect can be obtained. The coating layer of the ferrite powder may have a single layer or multilayer structure. In any case, it is preferred that the outermost layer of the surface is coated with at least a methylsilicone-containing resin or a phenylsilicone-containing resin. The weight ratio of the carrier to the toner in the developer is preferably from 100:1 to 100:10.

The core of the conductive fine particle in the present invention, may be a complex oxide prepared by doping, tin oxide and antimony oxide to titanium oxide, or a complex oxide prepared by doping antimony oxide to tin oxide, which has no magnetic property, or magnetite ($Fe_3O_4$), maghemite ($\alpha$-$Fe_2O_3$) or ferrite ($M_xFe_{3-x}O_4$ wherein M is Mn, Fe, Co, Ni, Cn, Mg, Zn, Cd or the like, or a mixed crystal system thereof), which has a magnetic property.

The specific resistance of the core of the conductive fine particle is preferably not more than $10^{10}$ Ωcm, more preferably not more than $10^7$ Ωcm as the value obtained by placing a sample between parallel electrode plates and measuring the resistance by an insulation resistance meter upon application of a DC voltage of 100 V.

In the present invention, the conductive fine particles are surface-treated with a positively chargeable resin, particularly a styrene-acrylic resin having amino groups, to have its chargeability adjusted to a positively chargeable direction. The styrene-acrylic resin having amino groups, is a styrene-acrylic resin having amino groups such as dimethylamino groups or diethylamino groups in its side chains and can be selected from a wide range of conventional resins. However, a resin obtained by copolymerizing an acrylic acid alkylamino ester or a methacrylic acid alkylamino ester with a styrene-acrylic copolymer monomer, is preferred. The nitrogen content in the styrene-acrylic resin having amino groups is preferably not more than 2%. The glass transition temperature of the resin is preferably at least 60° C.

The weight ratio of the conductive fine particles and the substance applied on their surface by the surface treatment, is not particularly limited, but is usually within a range of from 100:0.2 to 100:20.

The conductive fine particles thus treated are incorporated in an amount of from 0.02 to 5 parts by weight, preferably from 0.05 to 3 parts by weight, per 100 parts by weight of the toner particles. The specific resistance of the conductive fine particles after the treatment is preferably not more than $10^{13}$ Ωcm in order to maintain proper conductivity. The particle size of the fine particles may be obtained, for example, by the observation by a scanning electron microscope, followed by image-treatment, and the primary average particle size is at most 3 μm, more preferably from 0.01 to 1 μm. The method for treating the conductive fine particles with the specific resin is not particularly limited, and may, for example, be a method wherein the conductive fine particles and the specific resin are kneaded by e.g. a kneader, followed by rough pulverization.

As a method for pulverizing agglomerated fine particles, a method may, for example, be employed wherein the agglomerated particles are finely pulverized by means of a jet-type pulverizer and collected by a bag filter, followed by sieving. The particle size of the conductive fine particles may be measured by a method in accordance with item 20 of JIS K5101 (a method for testing the sieving residue of a pigment) and the residue of 325 mesh sieving should preferably be not more than 5%, more preferably not more than 2%.

By the addition of the conductive fine particles of the present invention, a polishing effect of the photoreceptor, an effect for adjusting the conductivity of the toner, an effect for controlling the chargeability of the toner or a composite effect thereof, can be expected. Further, by selecting the type and the amount of the surface treating substance, it is possible to control such effects.

The electrostatic image-developing positively chargeable toner of the present invention has good charging properties, such that it shows a proper level of stabilized chargeability constantly, whereby even when a developer is exposed at a high temperature of 40° C. or higher for a long period of time, which used to be problematic, and continuous copying is conducted by using this developer, no image-staining such as fogging will result, and a constant copy density can be obtained, or staining due to scattering of the toner in the copying machine is minimum. Thus, the toner of the present invention provides a substantial industrial merit.

Now, the present invention will be described in further detail with reference to Examples. However, it should be understood that the present invention is by no means restricted by such specific Examples.

In the following Examples, "parts" means "parts by weight" unless otherwise specified.

EXAMPLE 1

| | |
|---|---|
| A copolymer resin of styrene/n-butyl acrylate in a monomer weight ratio of 82/18 (glass transition temperature: 61° C.) | 100 parts |
| Colorant carbon black MA7 (manufactured by Mitsubishi Kasei Corporation) | 5 parts |
| Quaternary ammonium salt charge-controlling agent (a compound of the formula (I)) | 2 parts |
| Bontron P-51 (manufactured by Orient Chemical Company Ltd.) | |
| Low molecular weight polypropylene | 2 parts |
| Biscol 550P (manufactured by Sanyo Kasei K.K.) | |

The above materials were blended, kneaded, pulverized and classified to obtain a black toner having an average particle size of 10 μm.

0.5 part of surface-treated conductive fine particles (specific resistance: $10^{10}$–$10^{12}$ Ωcm) having an average particle size of about 0.3 μm obtained by surface-treating 100 parts of magnetite ($Fe_3O_4$, specific resistance: $10^6$–$10^7$ Ωcm) with 3 parts of a styrene-alkylacrylate copolymer having a glass transition temperature of 75° C. and positive chargeability and containing dimethylamino groups in its side chains (hereinafter referred to as treating resin A) and 0.2 part of a silica powder (R-972, manufactured by Nippon Aerosil K.K.) were added to 100 parts of the above black toner, and the mixture was mixed by a Henshell mixer. The conductive fine particles before the surface treatment and the conductive fine particles after the treatment were, respectively, mixed in a mixing ratio of 4.8% with a non-coated ferrite carrier (F-100, manufactured by Powdertech), and the respective mixtures were stirred for 30 minutes, whereupon the respective blow off charges were measured and found to be −7 μc/g and +13 μc/g, respectively. Then, 4 parts of the additive-treated toner and 100 parts of a spherical ferrite carrier having an average particle size of about 100 μm coated with a methylsilicone resin, were mixed and stirred to obtain a starting developer, and the same one as the additive-treated toner used for the starting developer, was used as a supplement toner.

Then, the starting developer and the supplement toner were, respectively, bottled, sealed, kept at 45° C. for 10 days, then cooled and subjected to a test by actually copying 20,000 sheets under an environmental condition of a temperature of from 23° to 25° C. under a relative humidity of from 60 to 65% by means of a copying machine employing an organic photoconductor as a photoreceptor. As a result of the actual copying test, there was no increase in fogging as a stain of the white background portion of copied paper during the actual copying of 20,000 sheets, and then density of the black portion of copied paper was constantly high. Further, there was no contamination due to scattering of the toner in the copying machine, and even when used after being exposed at a high temperature for a long period of time, the toner and the developer showed excellent durability and stability in the copied image quality.

EXAMPLE 2

A starting developer and a supplement toner were prepared in the same manner as in Example 1 except that 0.5 part of surface-treated conductive fine particles having an average particle size of 0.3 μm prepared by surface-treating 100 parts of fine particle cores of conductive titania obtained by doping 80 parts of tin oxide ($SnO_2$) and 10 parts of antimony oxide ($Sb_2O_4$) to 100 parts of titanium oxide ($TiO_2$), with 3 parts of the treating resin A, and 0.2 part of silica $R^{972}$ were used as the additives to the toner, and the same heat treatment as in Example 1 was applied, followed by the same actual copying test as in Example 1.

The results were satisfactory as shown in Table 1.

TABLE 1

| | Stain at the white background portion | Density of the balck portion | Scattering of the toner |
|---|---|---|---|
| Example 1 | Nil | Good | Nil |
| Example | Substantially nil | Good | Substantially nil |
| Example | Nil | Good | Nil |
| Comparative Example | Badly stained | Substantial change in the density | Substantial |
| Comparative Example | Very badly stained | Substantial change in the density | Very substantial |

EXAMPLE 3

The surface treatment-preparation of the developer-heat treatment-actual copying test were conducted in the same manner as in Example 2 except that the conductive fine particle cores were changed to ferrite fine particles containing 95 parts of FeO and 5 parts of ZnO.

The results were satisfactory as shown in Table 1.

COMPARATIVE EXAMPLE 1

The preparation of the developer-heat treatment-actual copying test were conducted in the same manner as in Example 1 using non-surface treated magnetite fine particles of Example 1.

The results were problematic as shown in Table 1.

COMPARATIVE EXAMPLE 2

The preparation of the developer-heat treatment-actual copying test were conducted in the same manner as in Example 2 using non-surface treated conductive titania fine particles of Example 2.

The results were problematic as shown in Table 1.

What is claimed is:

1. An electrostatic image-developing positively chargeable toner comprising at least toner particles containing a resin and a colorant, and conductive fine particles having their surface treated with a styrene-acrylic resin having amino groups.

2. The positively chargeable toner according to claim 1, wherein the toner particles further contain a quaternary ammonium salt.

3. The positively chargeable toner according to claim 2, wherein the quaternary ammonium salt is a compound of of the following formula (I):

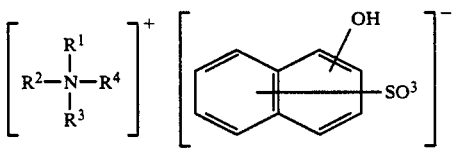

(I)

wherein each of $R^1$, $R^2$, $R^3$ and $R^4$ is a substituted or unsubstituted alkyl group or a substituted or unsubstituted aralkyl group.

4. The positively chargeable toner according to claim 2, wherein the quaternary ammonium salt is a compound of the following formula (II):

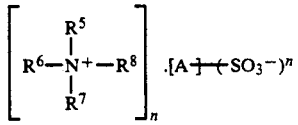

(II)

wherein each of $R^5$, $R^6$, $R^7$ and $R^8$ is a substituted or unsubstituted alkyl group or a substituted or unsubstituted aralkyl group, A is a benzene ring which may have a substituent or a naphthalene ring which may have a substituent, and n is an integer.

5. The positively chargeable toner according to claim 1, wherein the conductive fine particles are a non-magnetic complex oxide.

6. The positively chargeable toner according to claim 1, wherein the conductive fine particles are at least one member selected from the group consisting of a complex oxide prepared by doping tin oxide and antimony oxide to titanium oxide and a complex oxide prepared by doping antimony oxide to tin oxide.

7. The positively chargeable toner according to claim 1, wherein the conductive fine particles are a magnetic substance.

8. The positively chargeable toner according to claim 1, wherein the conductive fine particles are at least one member selected from the group consisting of magnetite, maghematite and ferrite.

9. The positively chargeable toner according to claim 1, wherein the specific resistance of the conductive fine particles is not more than $10^{10}$ Ωcm.

10. The positively chargeable toner according to claim 1, wherein the specific resistance of the conductive fine particles is not more than $10^{7}$ Ωcm.

11. The positively chargeable toner according to claim 1, wherein the specific resistance of the surface treated conductive fine particles is not more than $10^{-13}$ Ωcm.

12. The positively chargeable toner according to claim 1, wherein the styrene-acrylic resin has a glass transition temperature of at least 60° C.

13. The positively chargeable toner according to claim 1, wherein the content of the surface-treated conductive fine particles is from 0.02 to 5 parts by weight per 100 parts by weight of the toner particles.

14. The positively chargeable toner according to claim 1, wherein the weight ratio of the conductive fine particles and the styrene-acrylic resin deposited on the surface thereof is such that the styrene-acrylic resin is in an amount of from 0.2 to 20 parts by weight per 100 parts by weight of the conductive fine particles.

15. An electrostatic image-developer comprising at least toner particles containing a resin and a colorant, conductive fine particles having their surface treated with a positively chargeable resin, and ferrite powder coated with a silicone resin.

16. The electrostatic image-developer according to claim 15, wherein the positively chargeable resin is a styrene-acrylic resin having amino groups.

17. The electrostatic image-developer according to claim 15, wherein the toner particles further contain a quaternary ammonium salt.

* * * * *